US009085143B2

(12) United States Patent
Ishida et al.

(10) Patent No.: US 9,085,143 B2
(45) Date of Patent: Jul. 21, 2015

(54) SUBSTRATE FOR INKJET PRINT HEAD, INKJET PRINT HEAD, METHOD FOR MANUFACTURING INKJET PRINT HEAD, AND INKJET PRINTING APPARATUS

(71) Applicant: CANON KABUSHIKI KAISHA, Tokyo (JP)

(72) Inventors: Yuzuru Ishida, Yokohama (JP); Makoto Sakurai, Kawasaki (JP); Takuya Hatsui, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/138,344

(22) Filed: Dec. 23, 2013

(65) Prior Publication Data

US 2014/0184702 A1 Jul. 3, 2014

(30) Foreign Application Priority Data

Dec. 27, 2012 (JP) ..... 2012-285445

(51) Int. Cl.

| | |
|---|---|
| ***B41J 2/05*** | (2006.01) |
| ***B41J 2/14*** | (2006.01) |
| ***B41J 2/045*** | (2006.01) |

(52) U.S. Cl.

CPC ..... *B41J 2/14088* (2013.01); *B41J 2/0451* (2013.01); *B41J 2/0458* (2013.01); *B41J 2/04513* (2013.01); *B41J 2/1412* (2013.01); *B41J 2/14072* (2013.01); *B41J 2/14129* (2013.01)

(58) Field of Classification Search

None

See application file for complete search history.

(56) References Cited

U.S. PATENT DOCUMENTS

| | | | |
|---|---|---|---|
| 4,777,494 | A | 10/1988 | Shibata et al. |
| 6,022,098 | A | 2/2000 | Fujii |
| 6,231,166 | B1 | 5/2001 | Kawai et al. |
| 6,361,150 | B1 | 3/2002 | Schulte et al. |

(Continued)

FOREIGN PATENT DOCUMENTS

| | | |
|---|---|---|
| CN | 1418150 | 5/2003 |
| CN | 1732087 A | 2/2006 |

(Continued)

OTHER PUBLICATIONS

U.S. Appl. No. 14/138,287, filed Dec. 23, 2013.

(Continued)

*Primary Examiner* — Geoffrey Mruk

(74) *Attorney, Agent, or Firm* — Fitzpatrick, Cella, Harper & Scinto

(57) ABSTRACT

A substrate for an inkjet print head comprises: a base; a plurality of heating resistors for heating ink, the heating resistors being disposed on the base and producing heat in a case where the heating resistors are energized; a first protection layer disposed on the heating resistors and having insulation properties; and a second protection layer disposed on the first protection layer and having conductivity. The second protection layer includes individual sections disposed to individually cover the plurality of heating resistors, a common section connecting the individual sections, and connection sections interposed between the individual sections and the common section and connecting the individual sections and the common section. The connection sections are disposed at positions to be in contact with ink, and include a material which changes to an insulating film by an electrochemical reaction with the ink.

11 Claims, 9 Drawing Sheets

(56) References Cited

U.S. PATENT DOCUMENTS

| | | | | |
|---|---|---|---|---|
| 6,395,148 | B1 | 5/2002 | Whitman | |
| 6,512,284 | B2 | 1/2003 | Schulte et al. | |
| 7,374,275 | B2 | 5/2008 | Shibata et al. | |
| 7,566,116 | B2 | 7/2009 | Saito et al. | |
| 7,862,155 | B2 | 1/2011 | Shibata et al. | |
| 7,896,476 | B2 | 3/2011 | Kubo et al. | |
| 7,954,238 | B2 | 6/2011 | Shibata et al. | |
| 8,070,267 | B2 | 12/2011 | Takeuchi et al. | |
| 8,075,102 | B2 | 12/2011 | Hatsui et al. | |
| 8,129,204 | B2 | 3/2012 | Saito et al. | |
| 2002/0130927 | A1 | 9/2002 | Miyakoshi et al. | |
| 2004/0017420 | A1 | 1/2004 | Miyamoto et al. | |
| 2005/0057611 | A1 | 3/2005 | Miyamoto et al. | |
| 2009/0315954 | A1* | 12/2009 | Sakurai et al. | 347/63 |
| 2010/0079551 | A1 | 4/2010 | Saito et al. | |
| 2012/0105537 | A1* | 5/2012 | Sakai et al. | 347/22 |

FOREIGN PATENT DOCUMENTS

| | | | |
|---|---|---|---|
| CN | 1736717 | | 2/2006 |
| EP | 0 636 478 | A2 | 2/1995 |
| EP | 1 080 897 | A2 | 3/2001 |
| EP | 1 352 744 | A2 | 10/2003 |
| JP | 2001-080073 | A | 3/2001 |

OTHER PUBLICATIONS

U.S. Appl. No. 14/138,295, filed Dec. 23, 2013.

Extended European Search Report issued in counterpart application No. 13005720.1 dated Mar. 18, 2014—6 pages.

Chinese office action issued in corresponding application No. 201310741565.0 dated Mar. 19, 2015 — 15 pages.

* cited by examiner

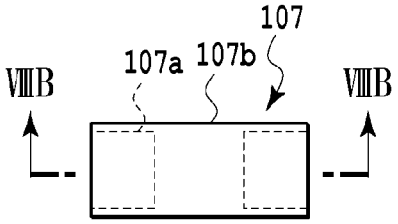
FIG.8A
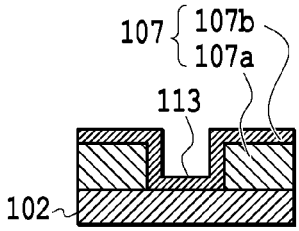
FIG.8B
FIG.8C
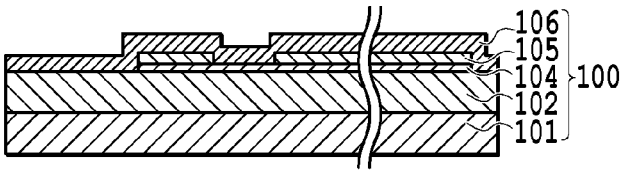
FIG.8D
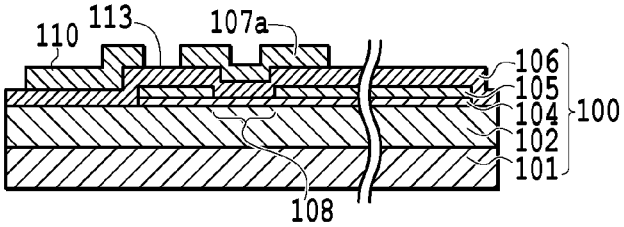
FIG.8E
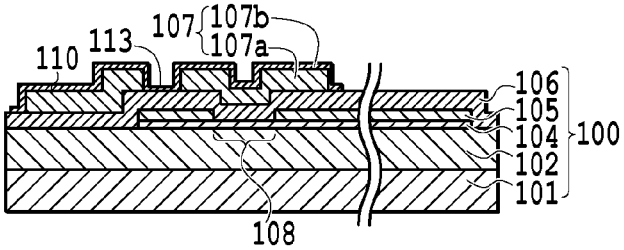
FIG.8F
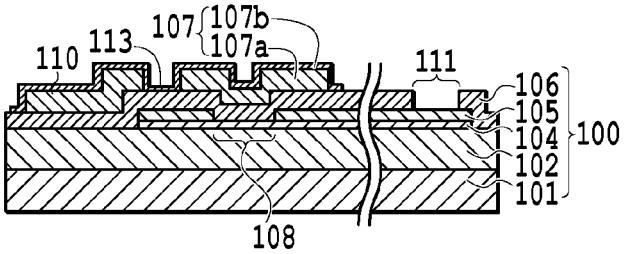
FIG.8G
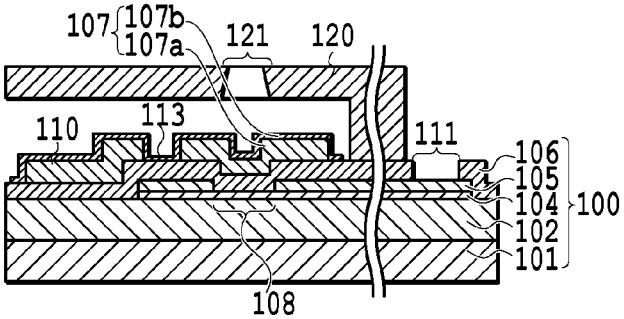

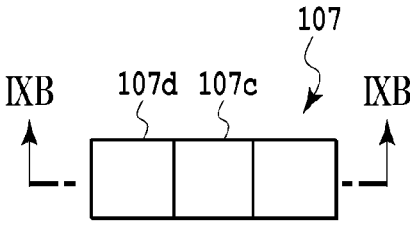
FIG.9A
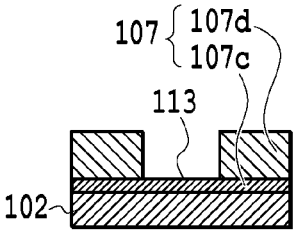
FIG.9B
FIG.9C
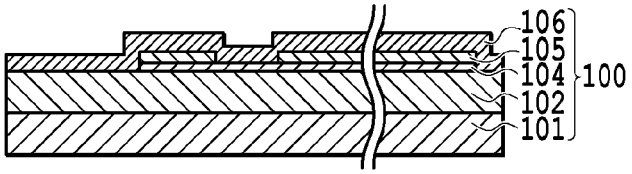
FIG.9D
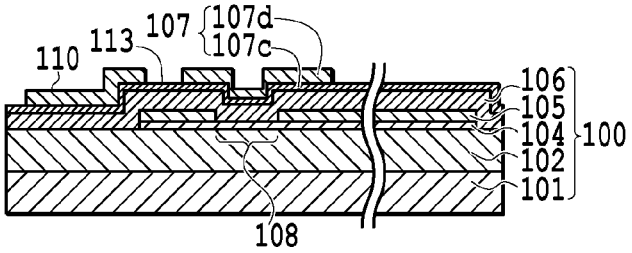
FIG.9E
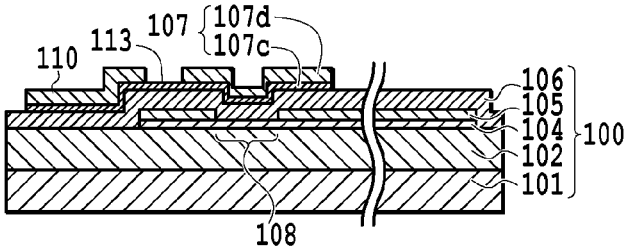
FIG.9F
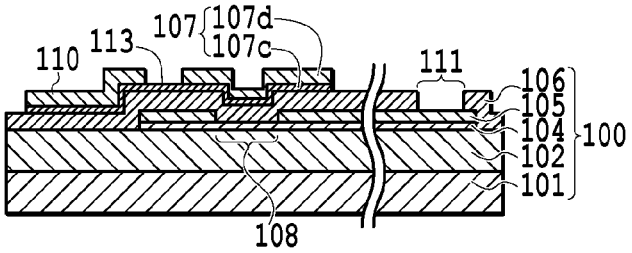
FIG.9G
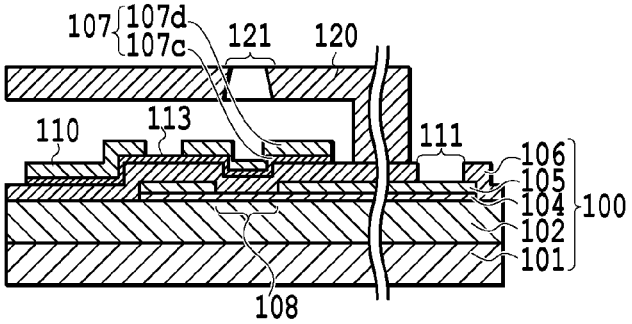

SUBSTRATE FOR INKJET PRINT HEAD, INKJET PRINT HEAD, METHOD FOR MANUFACTURING INKJET PRINT HEAD, AND INKJET PRINTING APPARATUS

BACKGROUND OF THE INVENTION

1. Field of the Invention

The present invention relates to a substrate for an inkjet print head for conducting printing on a print medium by ejecting ink according to an inkjet method, an inkjet print head having the substrate, a method for manufacturing the inkjet print head, and an inkjet printing apparatus.

2. Description of the Related Art

There is conventionally known an inkjet print head including liquid chambers and heating resistors near the liquid chambers wherein film boiling is caused in ink in the liquid chamber by heat generated by energizing the heating resistors, and the energy of a generated bubble causes the ink in the liquid chamber to be ejected.

At the time of printing, the heating resistors of the above inkjet print head are occasionally affected by physical action such as the impact of cavitation caused by bubble generation, shrinkage, and disappearing in ink and/or the chemical action of ink. In order to protect the heating resistors from the physical action and the chemical action, an upper protection layer is disposed to cover upper portions of the heating resistors.

This upper protection layer is disposed at a position to be in contact with ink. Further, since the upper protection layer is formed above the upper portions of the heating resistors, the temperature of the upper protection layer rises instantly. In such a severe environment, the upper protection layer is normally likely to corrode. Accordingly, the upper protection layer is formed with a material which has excellent resistance to the physical action and the chemical action such as impact resistance, heat resistance, and corrosion resistance. More specifically, the upper protection layer is formed with a metal film of Ta (tantalum), a platinum group element Ir (iridium) or Ru (ruthenium), or the like satisfying the above conditions.

Incidentally, these materials are conductive. In a case where a current flows through the upper protection layer, an electrochemical reaction occasionally occurs between the upper protection layer and ink, thereby damaging the function of the upper protection layer. In order to prevent this, an insulating layer (a protection layer having electrical insulation properties) is disposed between the heating resistors and the upper protection layer so that a current supplied to the heating resistors does not flow through the upper protection layer.

In such a configuration, there is a case where a short circuit occurs for some reason and a current directly flows from the heating resistors or wiring connected thereto to the upper protection layer. In a case where the short circuit causes the current to flow through the upper protection layer, an electrochemical reaction between the upper protection layer and ink occasionally occurs in a region through which the current flows, thereby degenerating the upper protection layer.

In order to prevent the short circuit from degenerating a large portion of the upper protection layer, it is considered effective to provide the upper protection layer such that in a case where the short circuit occurs, the region of the upper protection layer in which the short circuit occurs can be electrically separated from the other region.

Japanese Patent Laid-Open No. 2001-080073 discloses that in order to protect constituent elements of an inkjet print head from electrostatic discharge, a plurality of tantalum layers disposed to individually cover heating resistors are connected via fuse elements each of which is blown in a case where the corresponding heating resistor is damaged.

SUMMARY OF THE INVENTION

In such a configuration, the upper protection layer needs to serve two roles. One of the roles is to protect lower constituent elements below the upper protection layer from the physical action and the chemical action, and this role is the original role of the upper protection layer. In order to serve this role, the upper protection layer needs to have a certain level of thickness. The other role is to form part of the upper protection layer to be the fuse elements and in a case where one of the heating resistors is damaged, blow the corresponding fuse element. Since high-melting-point metal such as Ta or a platinum group element is used for the upper protection layer, large energy is necessary to blow the fuse elements. Accordingly, in order to achieve this role, it is desirable that the upper protection layer be as thin as possible. In other words, there is a problem that the two roles have contradictory requirements for a film thickness. For example, there is a concern that in a case where the upper protection layer is designed to be thick to achieve the long life of the print head, it becomes difficult to blow the fuse elements and the reliability of the inkjet print head is lowered.

Therefore, an object of the present invention is to provide an inkjet print head having both long life and high reliability. Further, another object of the present invention is to provide a method for manufacturing the inkjet print head, a substrate for the inkjet print head, and an inkjet printing apparatus.

According to the present invention which solves the above problem, there is provided a substrate for an inkjet print head comprising: a base; a plurality of heating resistors for heating ink, the heating resistors being disposed on the base and producing heat in a case where the heating resistors are energized; a first protection layer disposed on the heating resistors and having insulation properties; and a second protection layer disposed on the first protection layer and having conductivity, wherein the second protection layer includes individual sections disposed to individually cover the plurality of heating resistors, a common section connecting the individual sections, and connection sections interposed between the individual sections and the common section and connecting the individual sections and the common section, and the connection sections are disposed at positions to be in contact with ink, and include a material which changes to an insulating film by an electrochemical reaction with the ink.

In the configuration of the present invention, in a case where a short circuit occurs in the upper protection layer, an electrochemical reaction between the upper protection layer and ink forms an insulating layer in the connection sections connecting the individual sections and the common section. This enables a region of the upper protection layer in which the short circuit occurs to be separated from the other regions. The present invention can separate the region of the upper protection layer in which the short circuit occurs from the other regions without requiring large energy for blowing fuse elements. Further, according to the present invention, in a case where the upper protection layer is separated, the upper protection layer does not reach a high temperature like the one in a case where fuse elements are blown. Accordingly, damage to nozzles can be reduced.

Further features of the present invention will become apparent from the following description of exemplary embodiments (with reference to the attached drawings).

BRIEF DESCRIPTION OF THE DRAWINGS

FIGS. 8A and 8B are schematic views of a thin film region of an upper protection layer of a second embodiment;

FIGS. 8C to 8G are views for explaining a process for manufacturing the thin film region of the upper protection layer of the second embodiment;

FIGS. 9A and 9B are schematic views of a thin film region of an upper protection layer of a third embodiment; and FIGS. 9C to 9G are views for explaining a process for manufacturing the thin film region of the upper protection layer of the third embodiment.

DESCRIPTION OF THE EMBODIMENTS

With reference to the drawings, explanation will be made below on an inkjet printing apparatus, an inkjet print head, and a substrate for the inkjet print head according to embodiments of the present invention.

(First Embodiment)

Figure 1:
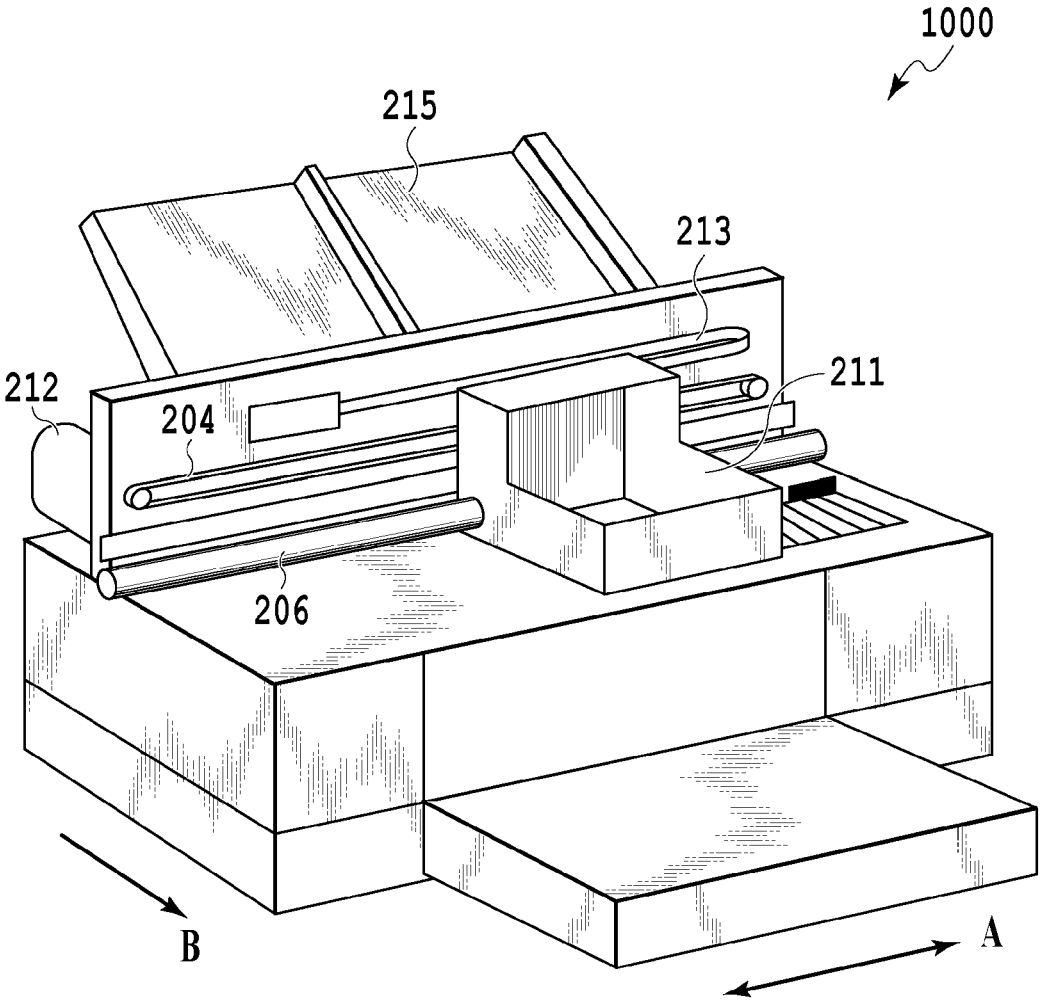
FIG. 1 is a schematic perspective view of an inkjet printing apparatus of a first embodiment.

FIG. 1 is a schematic perspective view of an inkjet printing apparatus of a first embodiment of the present invention. An inkjet printing apparatus 1000 shown in FIG. 1 includes a carriage 211 for mounting an inkjet print head unit 410 shown in FIG. 2A so that an ink ejection face of an inkjet print head 1 faces a print medium.

The carriage 211 is guided and supported by a guide shaft 206 so that the carriage 211 can move in a main scan direction shown by an arrow A. The guide shaft 206 is disposed to extend in a width direction of a print medium. A belt 204 is attached to the carriage 211. The belt 204 is connected to a carriage motor 212 via a pulley. The driving force of the carriage motor 212 is transmitted to the carriage 211 through the belt 204, whereby the carriage 211 moves along the guide shaft 206.

A flexible cable 213 is attached to the carriage 211. The flexible cable 213 is configured to be connected to the inkjet print head unit 410 in a case where the inkjet print head unit 410 is mounted in the carriage. According to print data, an electrical signal from a control unit which is not shown in the figure is transferred to the inkjet print head 1.

A print medium is fed from a sheet feeding section 215 and conveyed by a conveyance roller which is not shown in the figure in a conveying direction, that is, a sub-scan direction shown by an arrow B.

The inkjet printing apparatus 1000 sequentially prints an image on the print medium by repeating a printing operation of ejecting ink while moving the inkjet print head 1 in the main scan direction and a conveying operation of conveying the print medium in the sub-scan direction.

As described above, the inkjet printing apparatus 1000 of the present embodiment is a so-called serial-scan type inkjet printing apparatus which prints an image by moving the inkjet print head 1 in the main scan direction and conveying the print medium in the sub-scan direction. Incidentally, the present invention is not limited to this, and can also be applied to a so-called full-line type inkjet printing apparatus using an inkjet print head which extends the entire width of a print medium.

Figure 2A:
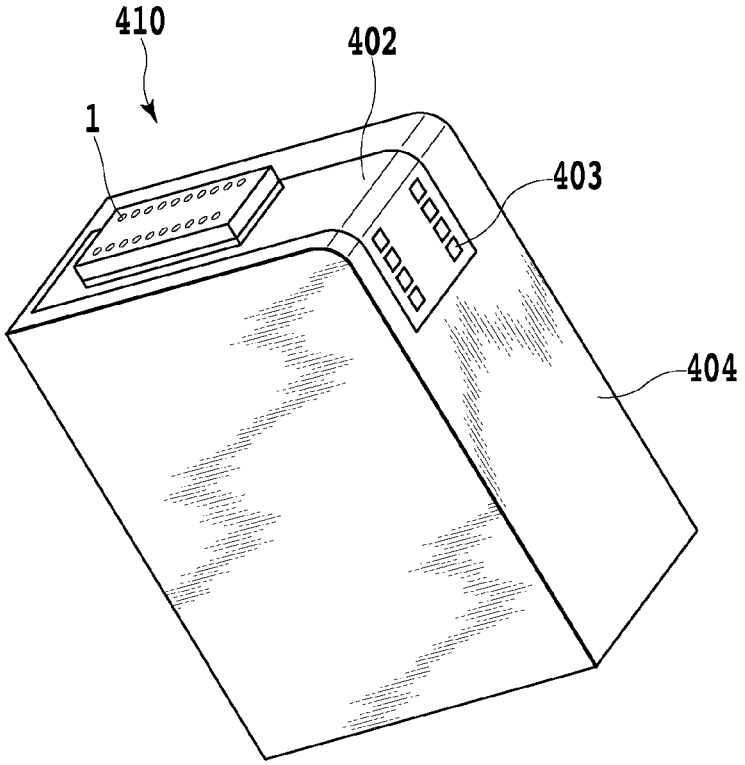
FIG. 2A is a schematic perspective view of an inkjet print head unit of the first embodiment.

FIG. 2A is a schematic perspective view of the inkjet print head unit of the first embodiment. The inkjet print head unit 410 shown in FIG. 2A is in the form of a cartridge in which the inkjet print head 1 is integral with an ink tank 404. The ink tank 404 temporarily stores ink therein, and supplies the ink to the inkjet print head 1.

The inkjet print head unit 410 can be mounted in and demounted from the carriage 211 shown in FIG. 1. A tape member 402 for Tape Automated Bonding (TAB) having a terminal for supplying power is attached to the inkjet print head unit 410. Power is selectively supplied from contacts 403 to thermal action sections 117 of the inkjet print head 1 through the tape member 402.

Incidentally, the inkjet print head of the present invention is not limited to the form of the above unit in which the inkjet print head is integral with the ink tank. For example, the inkjet print head may be in a form that an ink tank is removably mounted and that in a case where the remaining amount of ink in the ink tank reaches zero, the ink tank is demounted and a new ink tank is mounted. Further, the inkjet print head may be in a form that the inkjet print head is separate from the ink tank and that ink is supplied via a tube or the like.

Further, the inkjet print head of the present invention is not limited to the one applied to a serial type inkjet printing apparatus. The inkjet print head of the present invention may be an inkjet print head having nozzles across a region corresponding to the entire width of a print medium like the one applied to a line type inkjet printing apparatus.

Figure 2B:
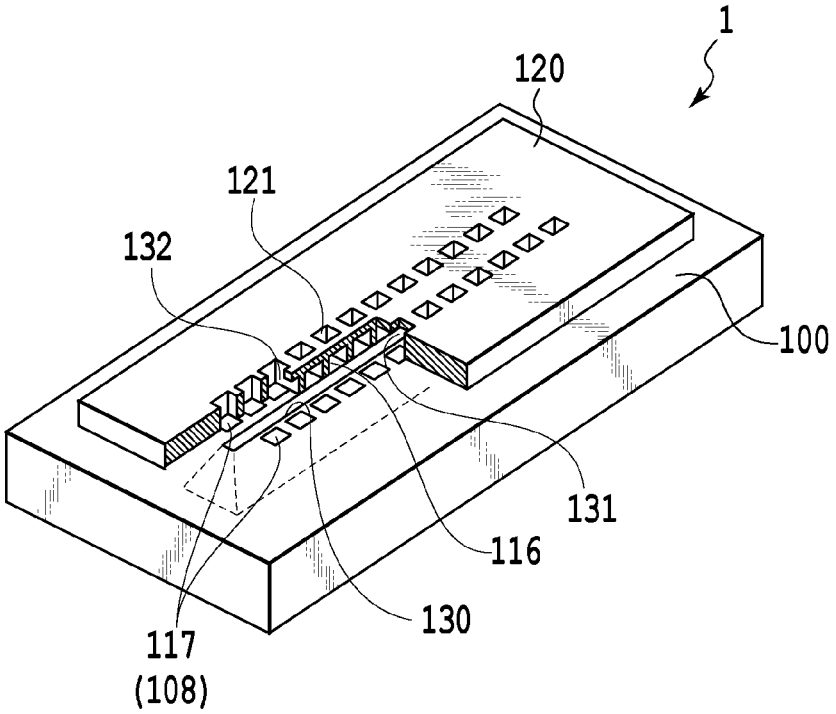
FIG. 2B is a schematic perspective view of an inkjet print head of the first embodiment.

FIG. 2B is a schematic perspective view of the inkjet print head of the first embodiment. FIG. 2B is a partially cutaway view of the inkjet print head 1.

In the inkjet print head 1 of the present embodiment, a flow path forming member 120 is disposed on a substrate 100 for the inkjet print head. Between the substrate 100 for the inkjet print head and the flow path forming member 120, there are defined a plurality of liquid chambers 132 capable of storing ink therein, ink flow paths 116 which are in communication with the liquid chambers 132, and a common liquid chamber 131 which is in communication with the liquid chambers 132 via the ink flow paths. The substrate 100 for the inkjet print head has an ink supply port 130 penetrating the substrate 100 for the inkjet print head. The ink supply port 130 is disposed to correspond to the common liquid chamber 131 and is in the shape of a rectangle extending in an arrangement direction of the plurality of liquid chambers 132. The common liquid chamber 131 is in communication with the ink supply port 130.

The liquid chambers 132 include the thermal action sections 117 therein. Ejection ports 121 are formed at positions corresponding to the thermal action sections 117 in the flow path forming member 120. Further, heating resistors 108 are disposed at positions corresponding to the thermal action sections 117 of the substrate 100 for the inkjet print head.

In a case where ink is supplied from the ink tank 404 to the inkjet print head 1, the ink is supplied to the common liquid chamber 131 through the ink supply port 130 of the substrate 100 for the inkjet print head. The ink supplied to the common liquid chamber 131 is supplied to the liquid chambers 132 through the ink flow paths 116. On this occasion, capillary action causes the ink in the common liquid chamber 131 to be supplied to the ink flow paths 116 and the liquid chambers 132, and a meniscus is formed at the ejection ports 121, whereby the liquid surface of ink can be stably held.

In order to eject ink, the heating resistors 108 disposed at positions corresponding to the liquid chambers 132 are energized through wiring to generate thermal energy in the heating resistors 108. As a result, the ink in the liquid chambers 132 is heated and bubbles are generated by film boiling. The energy of the bubble generation causes ink droplets to be ejected from the ejection ports 121.

Figure 3A:
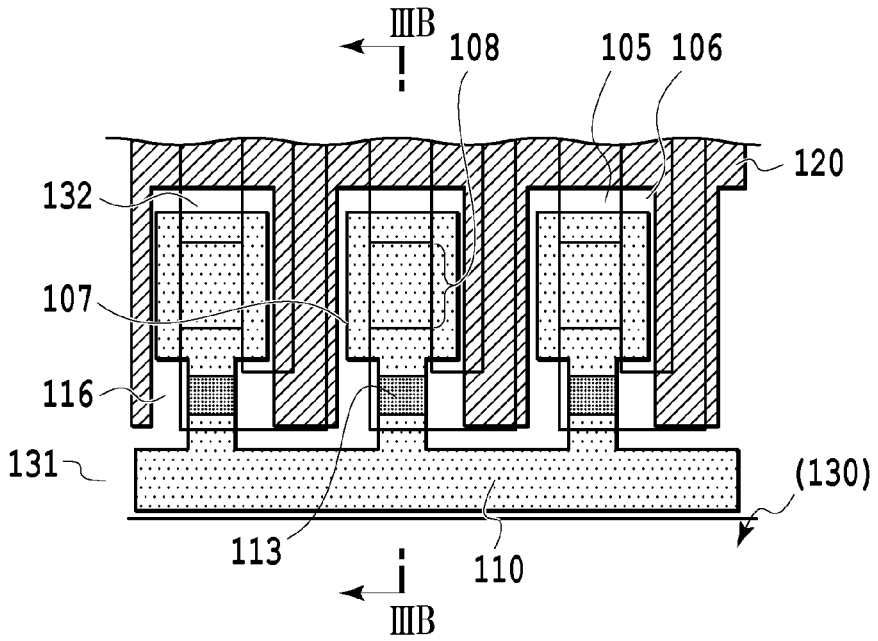
FIG. 3A is a schematic plan view of a portion around thermal action sections of a substrate for the inkjet print head of the first embodiment.
Figure 3B:
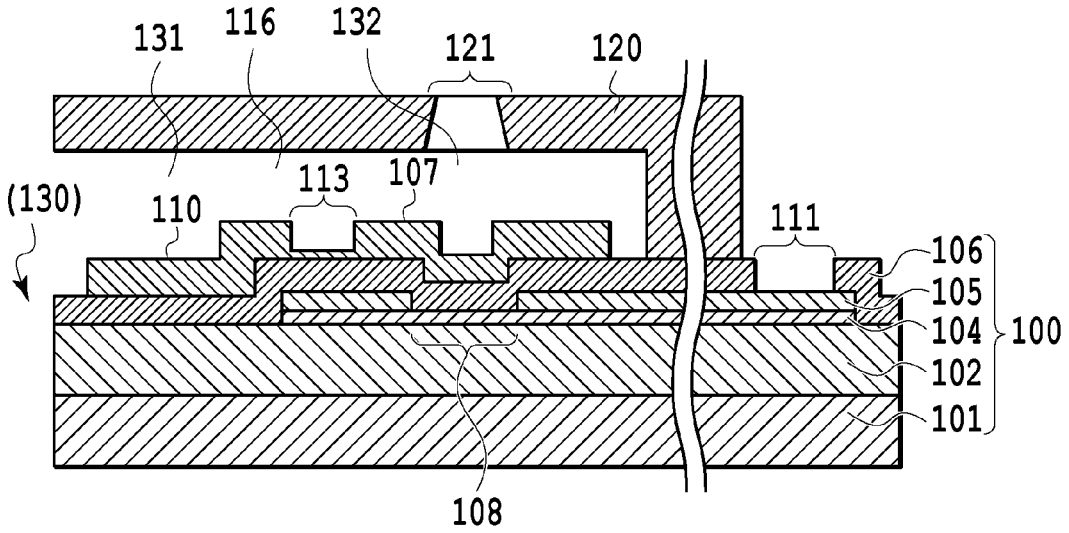
FIG. 3B is a cross-sectional view of the portion around the thermal action sections of the substrate for the inkjet print head of the first embodiment.

FIG. 3A is a schematic plan view of a portion around the thermal action sections of the inkjet print head of the first embodiment of the present invention. FIG. 3B is a partial schematic cross-sectional view of the substrate taken along line IIIb-IIIb of FIG. 3A.

The inkjet print head 1, part of which is schematically shown in FIGS. 3A and 3B, comprises the substrate 100 for the inkjet print head and the flow path forming member 120 adhered to the substrate for the inkjet print head. In FIG. 3A which is a plan view, a region shown as the flow path forming member 120 is a contact surface between the flow path forming member 120 and the substrate 100 for the inkjet print head.

The substrate 100 for the inkjet print head comprises a silicon base 101. A heat accumulating layer 102 is disposed on the base to suppress dissipation of heat generated by the heating resistors 108. The heat accumulating layer 102 is made of a thermally-oxidized film, a SiO (silicon oxide) film, a SiN (silicon nitride) film, or the like.

A heating resistor layer 104 and an electrode wiring layer 105 are disposed on the heat accumulating layer 102. The heating resistor layer 104 is made of resistors having the function of electrothermal conversion elements which generate heat in a case where the electrothermal conversion elements are energized. The electrode wiring layer 105 is made of a metal material such as Al (aluminum), Al—Si (aluminum-silicon), or Al—Cu (aluminum-copper), and functions as electric wiring.

The heating resistors 108 are formed by removing part of the electrode wiring layer 105 to form gaps and exposing corresponding portions of the heating resistor layer 104. More specifically, the electrode wiring layer 105 is adjacent to the heating resistor layer 104 and consists of two portions disposed with the gaps therebetween. Further, the heating resistors 108 consist only of the heating resistor layer 104. A current flows from one portion of the electrode wiring layer 105 to the other portion thereof, which are disposed separately, through the heating resistors 108, whereby the heating resistors 108 produce heat. The plurality of heating resistors 108 are arranged, and the ink supply port 130 extends along the arrangement direction of the heating resistors 108.

The electrode wiring layer 105 is connected to a driving element circuit or an external power supply terminal which are not shown in the figures and can receive power from the outside. In the embodiment shown in the figures, the electrode wiring layer 105 is disposed on the heating resistor layer 104, but it is possible to form the electrode wiring layer 105 on the base 101 or the heat accumulating layer 102, remove part of the electrode wiring layer 105 to form gaps, and dispose the heating resistor layer 104 over the electrode wiring layer 105 and the gaps.

A protection layer 106 is disposed on the heating resistors 108 and the electrode wiring layer 105 and protects lower constituent elements below the protection layer 106 and functions as an insulating layer. The protection layer 106 is made of a SiO film, a SiN film, or the like.

An upper protection layer 107 is disposed on the protection layer 106. The upper protection layer 107 protects the heating resistors 108 from chemical action and physical impact caused by heat of the heating resistors 108. In the present embodiment, the upper protection layer 107 is made of Ta (tantalum) or a platinum group element such as Ir (iridium) or Ru (ruthenium).

The upper protection layer 107 includes a plurality of individual sections disposed to individually cover upper portions of the heating resistors 108 for the original purpose of protection and a common section 110 which connects the plurality of individual sections, and which is disposed to avoid the upper portions of the heating resistors 108.

With reference to FIG. 3A, in the present embodiment, the individual sections of the upper protection layer 107 corresponding to the adjacent heating resistors 108 are disposed with gaps therebetween in the arrangement direction of the heating resistors 108. The common section 110 includes a band portion extending in the form of a band in the arrangement direction of the heating resistors 108 outside the liquid chambers 132 and a branch portion branching from the band portion into the liquid chambers 132 and connected to each individual section. Between the individual sections and the branch portion of the common section 110, there are provided thin film regions 113 in which the film thickness of the upper protection layer 107 is small. More specifically, the thin film regions 113 are connection sections which connect the common section 110 and the individual sections of the upper protection layer 107 corresponding to the heating resistors 108.

Figure 4A:
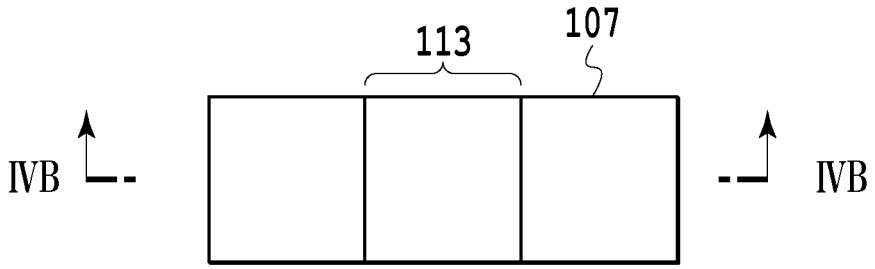
FIG. 4A is a plan view of a thin film region of an upper protection layer of the first embodiment.
Figure 4B:
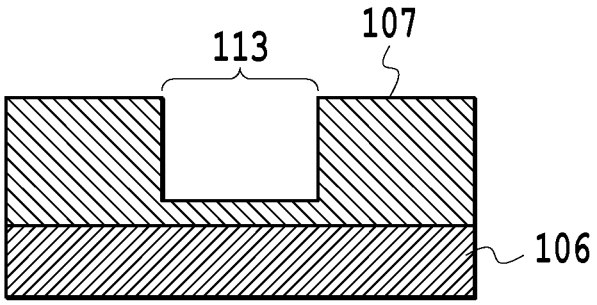
FIG. 4B is a schematic cross-sectional view of the thin film region of the upper protection layer of the first embodiment.

FIG. 4A is a schematic plan view showing the thin film region 113 of the upper protection layer 107. FIG. 4B is a partial schematic cross-sectional view of the substrate taken along line IVb-IVb of FIG. 4A. The thin film region 113 of the upper protection layer is positioned in regions where ink is contacted such as the ink chambers or the ink flow paths in a case where the inkjet print head is formed. The upper protection layer 107 above the heating resistors 108 is formed to have a large thickness in the range of about 200 to 500 nm in order to achieve a long life. Further, the thin film region 113 of the upper protection layer is formed to have a small thickness in the range of 10 to 50 nm so that in a case where a short circuit occurs, an insulating layer is formed easily in the thin film region by anodization. The film thickness of the thin film region 113 is preferably in the range of 10 to 30 nm.

<Circuit Configuration>

Figure 5A:
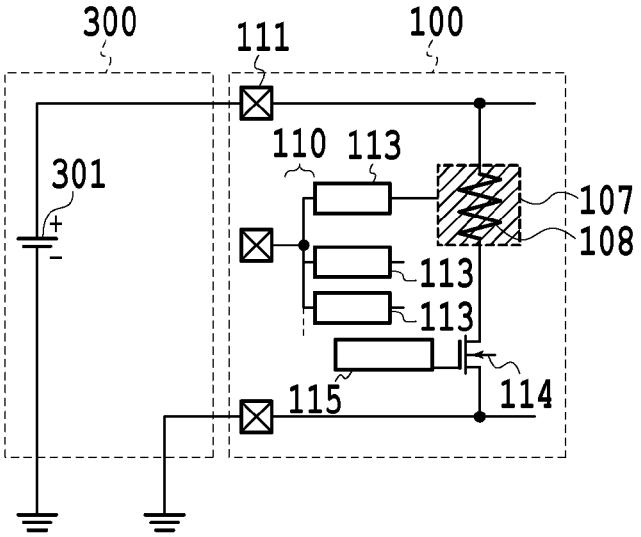
FIGS. 5A to 5C are circuit diagrams of the first embodiment.

FIG. 5A is a circuit diagram of the first embodiment of the present invention. An electrical diagram of the inkjet print head 1 is substantially identical to that of the substrate 100 for the inkjet print head and will be omitted. A selection circuit 115 selects a switching transistor 114 provided for each of the plurality of heating resistors 108, thereby driving the plurality of heating resistors 108. The individual sections of the upper protection layer 107 provided to cover the upper portions of the heating resistors 108 are connected to an external electrode 111 via the thin film regions 113 and the common section 110. The common section 110 has the function of electric wiring. The external electrode 111 is grounded through an inkjet printing apparatus 300. A power supply 301 drives the heating resistors 108 and applies a voltage of 20 to 30 V.

Incidentally, polysilicon used for a general fuse element has a melting point of about 1400° C. In contrast, Ta used for the upper protection layer 107 is metal having a high melting point of about 4000° C. In order to blow the fuse element, it is necessary to melt and remove at least a certain volume of a material forming the fuse element. Accordingly, in a case where the fuse element is formed with Ta, large energy is necessary to blow or melt the fuse element. However, according to the present invention, the upper protection layer 107 is electrically cut by using an electrochemical reaction to change the upper protection layer 107 to the insulating layer instead of melting and removing the upper protection layer 107. Accordingly, the present invention requires relatively small energy to electrically cut the upper protection layer.

Figure 5B:
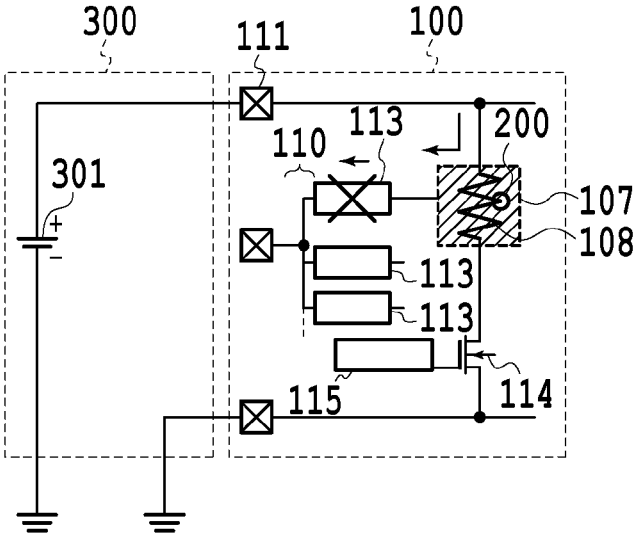

A state in which a short circuit occurs will be explained with reference to FIG. 5B. In a case where one of the heating resistors 108 is damaged, the protection layer 106 having the function of the insulating layer is ruptured. Then, part of the upper protection layer 107 is melted and directly contacts the heating resistor layer 104, and a short circuit 200 occurs between the heating resistor layer 104 and the upper protection layer 107. A voltage is constantly applied to the heating resistors 108. Accordingly, in a case where the short circuit 200 occurs between the heating resistor layer 104 and the upper protection layer 107, a voltage is applied to the upper protection layer 107, and the upper protection layer 107 is at the same voltage as the heating resistors 108. In a case where the heating resistors 108 are driven at a positive voltage, the upper protection layer 107 is instantly anodized by an electrochemical reaction between metal forming the upper protection layer 107 and ink whose potential is lower than that of the metal, and an oxidized film is formed on a surface which is in contact with ink.

According to the present invention, the thin film regions 113 are provided in the connection sections of the upper protection layer 107 between the individual sections provided to cover the upper portions of the heating resistors 108 and the common section 110 connecting the individual sections. In the thin film regions 113 of the present invention, the film thickness of the upper protection layer 107 is small as described above. More specifically, the film thickness of the thin film regions 113 of the upper protection layer 107 is smaller than that of the individual sections of the upper protection layer 107 to cover the upper portions of the heating resistors 108.

The film thickness of the oxidized film formed by anodization generally corresponds to the magnitude of an applied voltage. In a case where a voltage of 20 to 30 V is applied to one of the heating resistors 108, an oxidized film is formed in the entire corresponding thin film region 113 of the upper protection layer 107 in the film thickness direction and the thin film region changes to the insulating layer. In other words, in a case where the short circuit 200 occurs, the thin film region 113 adjacent to the individual section of the upper protection layer 107 in which the short circuit occurs changes to the insulating layer. Accordingly, since the insulating layer is interposed, the individual section of the upper protection layer 107 in which the short circuit 200 occurred is electrically separated from the individual sections of the upper protection layer 107 which covers the upper portions of the other heating resistors 108.

Therefore, the thin film regions 113 of the present invention interposed between the individual sections and the common section 110 of the upper protection layer 107 play a large role in achieving the long life of the entire substrate for inkjet printing.

The upper protection layer 107 is anodized also in a case where, for example, a pinhole or the like is formed in the protection layer 106 which insulates the electrode wiring layer 105 from elements on or above the electrode wiring layer 105 at the time of manufacturing, whereby the upper protection layer 107 and the electrode wiring layer 105 are connected. Accordingly, at the time of manufacturing, it is checked whether or not the insulation properties of the protection layer 106 are ensured.

Figure 5C:
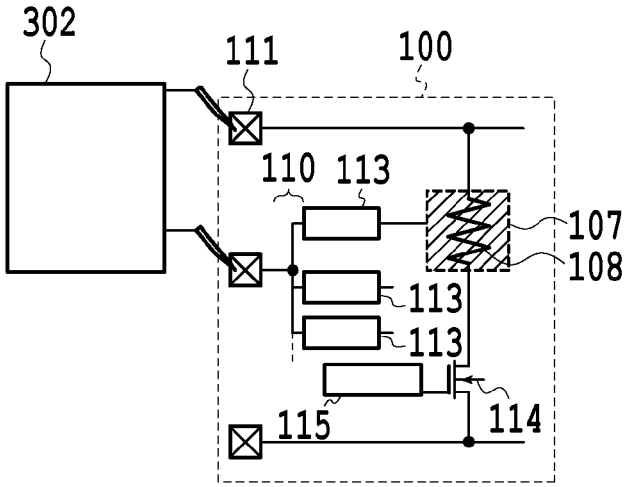

With reference to FIG. 5C, a test for checking the insulation properties of the protection layer 106 will be explained below. FIG. 5C is a circuit diagram at the time of a test for checking the insulation properties of the protection layer 106. Checking is performed by setting up a needle (probe pin) of a prober apparatus at the external electrode 111. The probe pin is connected to a measurement device 302. The measurement device 302 has a digital or analog measurement function used for various tests for checking whether the heating resistors 108 and the switching transistors 114 function normally and the like. Measurement is made of a flowing current by applying a voltage between the upper protection layer 107 and the heating resistors 108 or between the upper protection layer 107 and the electrode wiring layer 105 which is equal to or higher than an actually applied voltage in a case where the print head is used. It is optimum to perform this test at the timing when the upper protection layer 107 is formed and the external electrode 111 to which electricity is applied is formed. On this occasion, since the upper protection layer 107 and the thin film regions 113 do not contact ink, an electrochemical reaction such as anodizing via ink does not occur even if a voltage is applied. Accordingly, it is possible to measure, without any problems, a leak current between the upper protection layer 107 and the heating resistors 108 and/or between the upper protection layer 107 and the electrode wiring layer 105.

<Layer Structure of Inkjet Print Head and Manufacturing Method Thereof>

Explanation will be made below on an example of a process for manufacturing the inkjet print head of the first embodiment. FIGS. 6A to 6F are schematic cross-sectional views for explaining the process for manufacturing the inkjet print head shown in FIGS. 3A and 3B. Further, FIGS. 7A to 7E are schematic plan views for explaining the process for manufacturing the inkjet print head shown in FIGS. 3A and 3B.

The following manufacturing process is performed for the base 101 made of Si or a base into which a driving circuit having semiconductor elements such as the switching transistors 114 for selectively driving the heating resistors 108 is incorporated beforehand. For sake of simplification of explanation, the attached drawings show the base 101 made of Si.

First, with reference to FIG. 6A, the base 101 is subjected to the thermal oxidation method, the sputtering method, the CVD method, or the like to form the heat accumulating layer 102 made of a $SiO_2$ thermally-oxidized film as a lower layer below the heating resistor layer 104. Incidentally, regarding the base into which the driving circuit is incorporated beforehand, the heat accumulating layer can be formed during a process for manufacturing the driving circuit.

Figure 6A:
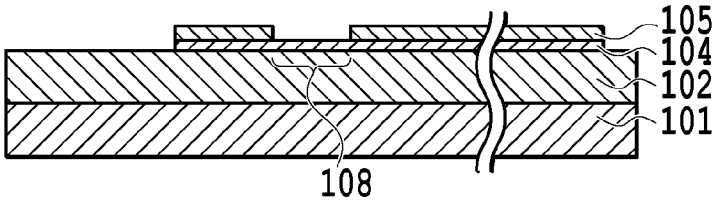
FIGS. 6A to 6F are schematic cross-sectional views for explaining a process for manufacturing the inkjet print head of the first embodiment.

Next, with reference to FIG. 6A, the heating resistor layer 104 of TaSiN or the like is formed on the heat accumulating layer 102 by reaction sputtering so that the heating resistor layer 104 has a thickness of about 50 nm. Further, an Al layer which is to be the electrode wiring layer 105 is formed on the heating resistor layer 104 by sputtering so that the electrode wiring layer 105 has a thickness of about 300 nm. Dry etching is simultaneously performed on the heating resistor layer 104 and the electrode wiring layer 105 by the photolithography method to obtain a planar shape shown in FIG. 7A. Incidentally, in the present embodiment, the reactive ion etching (RIE) method is used as dry etching.

Figure 7A:
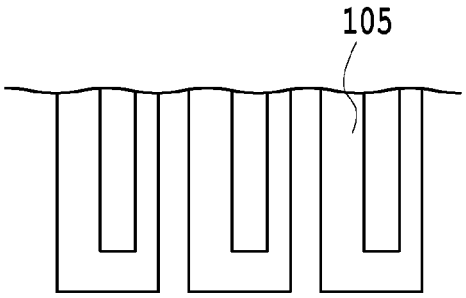
FIGS. 7A to 7F are schematic plan views for explaining the process for manufacturing the inkjet print head of the first embodiment.
Figure 7B:
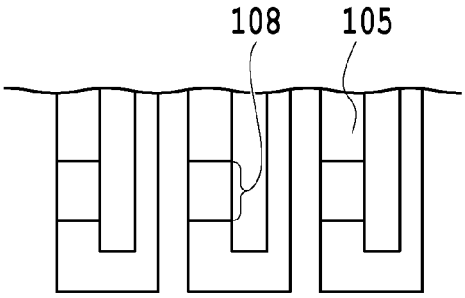

Next, in order to form the heating resistors 108, wet etching is performed by using the photolithography method again to partially remove the electrode wiring layer 105 made of Al and partially expose the heating resistor layer 104 as shown in FIGS. 6A and 7B. Incidentally, in order to achieve the excellent coverage properties of the protect layer 106 at wiring ends, it is desirable to perform publicly-known wet etching for obtaining an appropriate tapered shape at the wiring ends.

Figure 6B:
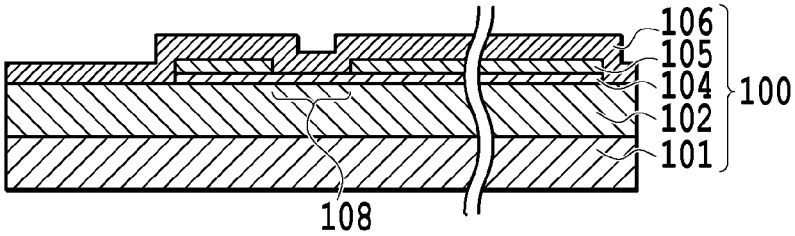
Figure 7C:
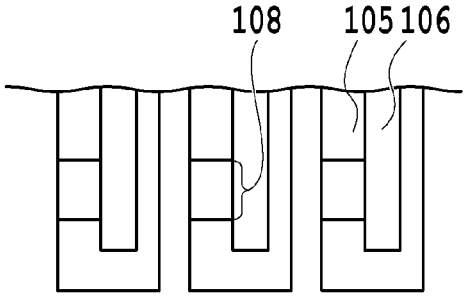

Thereafter, a SiN film as the protection layer 106 is formed to have a thickness of about 350 nm by the plasma CVD method as shown in FIGS. 6B and 7C.

Figure 6C:
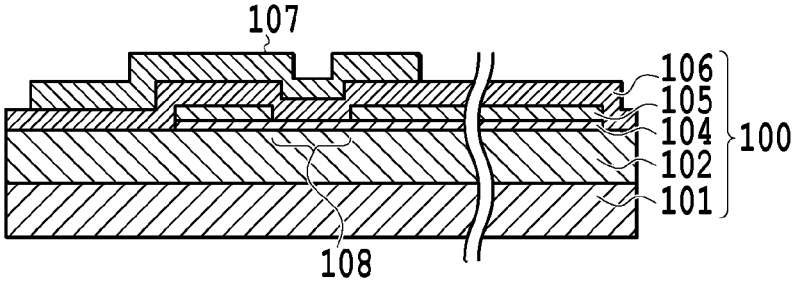
Figure 6D:
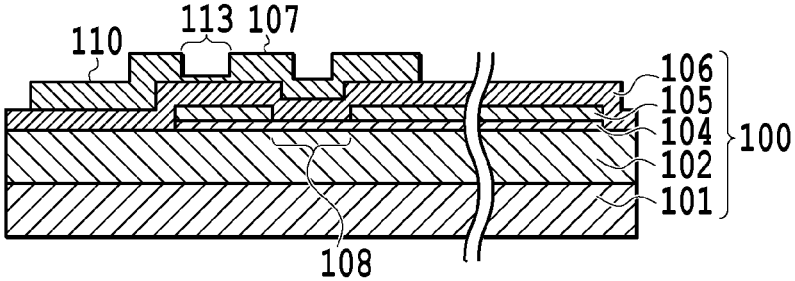
Figure 7D:
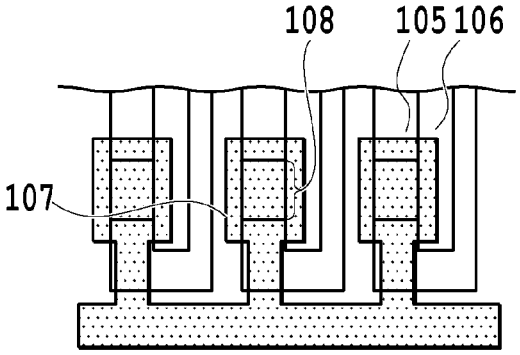
Figure 7E:
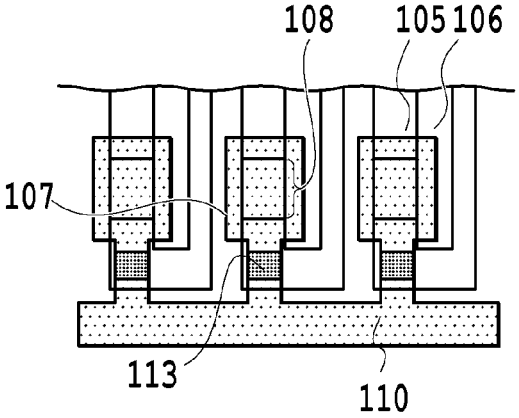
Figure 7F:
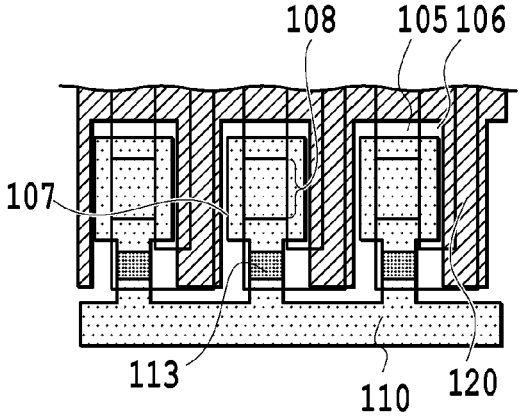

Next, a Ta layer as the upper protection layer 107 is formed on the protection layer 106 by sputtering so that the upper protection layer has a thickness of about 350 nm. Dry etching is performed by the photolithography method to partially remove the upper protection layer 107 and obtain the shape of the upper protection layer 107 as shown in FIGS. 6C and 7D. In this stage, the upper protection layer 107 includes the individual sections covering the heating resistors 108, the common section 110 connecting the individual sections, and the connection sections between the individual sections and the common section 110.

Next, dry etching is performed by the photolithography method only on the connection sections of the upper protection layer 107 between the individual sections and the common section 110 to form the thin film regions 113. On this occasion, etching is not performed on the entire upper protection layer 107 in the thickness direction and etching is stopped in a case where the thickness of the upper protection layer 107 reaches about 30 nm. The thin film regions 113 are formed in a shape shown in FIGS. 6D and 7E. The thin film regions 113 are formed at positions which are to directly contact ink in a case where the inkjet print head is used.

Figure 6E:
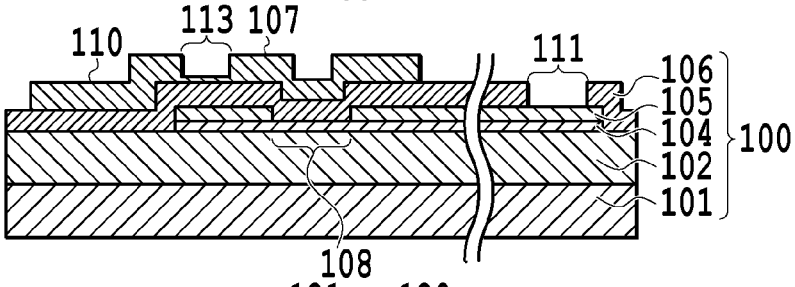

Next, in order to form the external electrode 111, dry etching is performed by the photolithography method to partially remove the protection layer 106 and partially expose a corresponding portion of the electrode wiring layer 105 as shown in FIG. 6E.

In the present embodiment, a Ta layer formed as one layer is subjected to half etching to reduce the film thickness of the thin film regions 113 as shown in FIG. 4B. The individual sections of the upper protection layer 107 covering the upper portions of the heating resistors 108 have a thickness of 350 nm which is large enough to achieve a long life. In contrast, the thin film regions 113 provided in the connection sections of the upper protection layer 107 have a thickness of 30 nm. In a case where the power supply 301 has a voltage of 24 V and the short circuit 200 occurs, the corresponding thin film region 113 is anodized by the electrochemical reaction with ink and the entire thin film region 113 becomes a Ta oxidized film to ensure the insulation properties.

On this occasion, only the thin film regions 113 may be thin or the entire common section 110 may also be formed to be a thin film. However, the common section 110 needs to efficiently pass current as electric wiring, and preferably has a certain level of thickness. For example, the common section 110 preferably has the same thickness (350 nm in the present embodiment) as the individual sections covering the upper portions of the heating resistors 108.

Figure 6F:
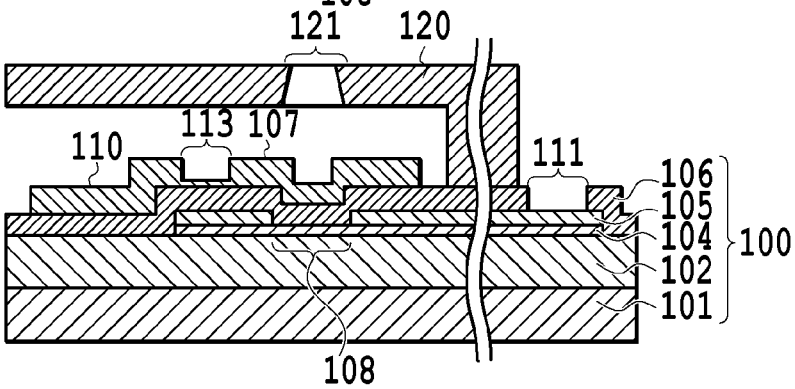

Next, with reference to FIG. 6F, the flow path forming member 120 is disposed on the upper side of the substrate 100 on which the upper protection layer 107 is disposed. The flow path forming member 120 defines the liquid chambers at the positions corresponding to the heating resistors 108 between the flow path forming member 120 and the substrate 100. The thin film regions 113 are disposed at the positions which are to contact ink in a case where the inkjet print head is used. Further, the flow path forming member 120 is provided with the ejection ports 121 positioned to face the heating resistors 108.

The inkjet print head of the first embodiment of the present invention is manufactured by the above process.

According to the features of the present embodiment, the thin film regions 113 of the upper protection layer 107 are made of Ta. The electrochemical reaction between the upper protection layer 107 and ink forms an insulating film in the thin film region, whereby the portion in which the short circuit occurred can be electrically separated. This can improve the reliability of the print head with relatively small energy without requiring large energy as in the case of using fuse elements to separate the portion in which the short circuit occurred. Further, in a case where the portion in which the short circuit occurred is separated, the upper protection layer 107 does not reach a high temperature as in the case of using fuse elements, and accordingly, it is possible to reduce damage to nozzles.

According to the above features, after one of the heating resistors 108 (heaters) is disconnected, the corresponding thin film region 113 is anodized to become the Ta oxidized film and remains. Accordingly, even after the heater is disconnected, the protection layer 106 below the thin film region 113 can be protected from being eluted by ink.

In the above features, after a test for checking the insulation properties of the above protection layer and before shipment, a positive potential may be applied to the common section 110 in a state in which the inkjet print head is filled with ink to form the insulating layer with the thin film regions 113 so that the individual sections of the upper protection layer 107 are electrically separated beforehand. In this case, since the individual sections 107 are already electrically separated before use, there is no need to concern about sequential alteration of a large portion of the upper protection layer 107 in a case where the short circuit occurs at the time of use.

(Second Embodiment)

A second embodiment of the present invention will be specifically explained below with reference to FIGS. 8A to 8G. Explanation of features similar to those of the first embodiment will be omitted.

FIG. 8A is a schematic plan view of a thin film region 113 of the second embodiment of the present invention. FIG. 8B is a partial schematic cross-sectional view of a substrate taken along line VIIIb-VIIIb of FIG. 8A. An upper protection layer 107 is divided into an upper protection layer 107*a* having a thickness of 300 nm and an upper protection layer 107*b* having a thickness of 30 nm, and both the upper protection layers 107*a* and 107*b* are formed of Ta on the heat accumulating layer 102 in the order named.

FIGS. 8C to 8G show an example of a process for manufacturing an inkjet print head of the second embodiment. FIG. 8C is identical to FIG. 6B for explaining the first embodiment. Steps performed to reach a state shown in FIG. 8C are identical to those of the first embodiment.

A Ta layer having a thickness of about 300 nm as the upper protection layer 107*a* is formed by sputtering on a protection layer 106 of a substrate 100 in a state shown in FIG. 8C. Dry etching is performed by the photolithography method to partially remove the upper protection layer 107*a* and obtain the shape of the upper protection layer 107*a* shown in FIG. 8D. At this stage, the upper protection layer does not exist in a portion corresponding to the thin film region 113.

Next, a Ta layer having a thickness of about 30 nm as the upper protection layer 107*b* is formed by sputtering on an upper surface of the upper protection layer 107*a*. Then dry etching is performed by the photolithography method to partially remove the upper protection layer 107*b* and obtain the shape of the upper protection layer 107*b* shown in FIG. 8E. This upper protection layer 107*b* covers the previously formed upper protection layer 107*a*. With reference to FIG. 8A which is a plan view, the upper protection layer 107*b* protrudes outward from the upper protection layer 107*a*. The upper protection layer 107*b* is also provided in the above-described portion corresponding to the thin film region 113 from which the upper protection layer 107*a* is removed.

Accordingly, in the present embodiment, the thin film region 113 of the upper protection layer 107 is made of Ta. According to this feature, an electrochemical reaction between the upper protection layer 107 and ink forms the insulation film in the thin film region, whereby a portion in which a short circuit occurred can be electrically separated.

Subsequent steps shown in FIGS. 8F and 8G are identical to those of the first embodiment shown in FIGS. 6E and 6F.

In the present embodiment, the film thickness of the thin film region 113 is determined based only on a condition of sputtering for the upper protection layer 107*b*, and it is easy to improve the precision of the film thickness of the thin film region 113.

(Third Embodiment)

A third embodiment of the present invention will be specifically explained with reference to FIGS. 9A to 9G. Explanation of features similar to those of the first embodiment will be omitted.

FIG. 9A is a schematic plan view of a thin film region 113 of an upper protection layer 107 of the third embodiment of the present invention. FIG. 9B is a partial schematic cross-sectional view of a substrate taken along line IXb-IXb of FIG. 9A. The upper protection layer 107 is divided into an upper protection layer 107*c* having a thickness of 50 nm and an upper protection layer 107*d* having a thickness of 250 nm and the upper protection layers 107*c* and 107*d* are formed on a heat accumulating layer 102 in the order named. The upper protection layer 107*c* is made of Ta, and the upper protection layer 107*d* is made of platinum group metal Ir.

The upper protection layer 107*c* and the upper protection layer 107*d* are formed in substantially identical patterns. In the thin film region 113, the upper protection layer 107*d* is removed and only the upper protection layer 107*c* exists.

FIGS. 9C to 9E show an example of a process for manufacturing an inkjet print head of the third embodiment. FIG. 9C is identical to FIG. 6B for explaining the first embodiment, and steps performed to reach a state shown in FIG. 9C are identical to those of the first embodiment.

A Ta layer having a thickness of about 50 nm as the upper protection layer 107*c* is formed by sputtering on a protection layer 106 of a substrate 100 in a state shown in FIG. 9C. Then an Ir layer having a thickness of about 250 nm is formed by sputtering as the upper protection layer 107*d*. Next, dry etching is performed by the photolithography method to remove a portion corresponding to the thin film region 113 of the upper protection layer 107*d* and obtain the shape of the upper protection layer 107*d* shown in FIG. 9D.

Dry etching is performed by the photolithography method to partially remove the upper protection layer 107*c* and obtain the shape of the upper protection layer 107*c* shown in FIG. 9E. With reference to FIG. 9A which is a plan view, a region in which the upper protection layer 107*d* is disposed is within a region in which the upper protection layer 107*c* is disposed. Further, the upper protection layer 107*d* does not exist in the thin film region 113.

Subsequent steps shown in FIGS. 9F and 9G are identical to those of the first embodiment shown in FIGS. 6E and 6F.

Both Ir used for the upper protection layer 107*d* and Ta used for the upper protection layer 107*c* are generally suitably used as materials for protecting heating resistors of the inkjet print head. These materials have conductivity.

When the upper protection layer 107 causes an electrochemical reaction with ink as an electrolyte solution, in a case where the constituent material is Ir, Ir itself as a metal ion is eluted in ink, and in a case where the constituent material is Ta, the upper protection layer 107 is anodized to form an oxidized film. In the present embodiment, the thin film region 113 of the upper protection layer 107 is made of Ta. In the present embodiment, an electrochemical reaction between the upper protection layer 107 and ink forms an insulation film in the thin film region 113, whereby a portion in which a short circuit occurred can be electrically separated.

It is known that Ir does not adhere tightly to SiN forming the protection layer 106. Further, Ir is a platinum group element and etching is generally performed by a more physical method. In this case, there is a possibility that SiN forming a foundation is also etched at a high speed, and that the function of the protection layer 106 is damaged.

On the other hand, Ta for the upper protection layer 107*c* interposed between the upper protection layer 107*d* and the protection layer 106 has the function of improving adhesiveness between these layers.

Accordingly, in the present embodiment in which the upper protection layer 107*c* made of Ta and the upper protection layer 107*d* made of Ir are provided on the protection layer 106 in the order named, it is easy to control etching at the time of manufacturing, and adhesiveness between the layers is high.

In the above embodiment, Ta is used as a material for the thin film region 113 of the upper protection layer. However, the present invention is not limited to this, and a material (such as Ta, Cr, Ni, or an alloy thereof) which changes to an insulation film as a result of an electrochemical reaction with ink can be used for the thin film region 113.

In the above embodiment, Ir is used as a material for the upper protection layer 107*d*. However, the present invention is not limited to this, and another platinum group element may be used for the upper protection layer 107*d* in place of Ir.

In the above embodiment, the two upper protection layers are formed. However, the present invention is not limited to this, and three or more upper protection layers may be formed. Further, in a case where a plurality of upper protection layers are formed, the number of materials for the upper protection layers may be one and may be two or more as long as the material(s) which change(s) to the insulation film as a result of an electrochemical reaction with ink is (are) used for the thin film region 113.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-285445 filed Dec. 27, 2012, which is hereby incorporated by reference herein in its entirety.

What is claimed is:

1. A substrate for an inkjet print head comprising:

a base;

a plurality of heating resistors for heating ink, the heating resistors being disposed on the base and producing heat in a case where the heating resistors are energized;

a first protection layer disposed on the heating resistors and having electrical insulation properties; and a second protection layer disposed on the first protection layer and having conductivity, wherein the second protection layer includes individual sections disposed to individually cover the plurality of heating resistors, a common section, and connection sections interposed between the individual sections and the common section and connecting the individual sections and the common section, the individual sections corresponding to adjacent heating sections are separated from each other with a gap therebetween, the connection sections respectively have a part, the cross-sectional area of which is narrower than a cross-sectional area of the corresponding individual sections, the cross-sectional areas being orthogonal to the base, and the connection sections are disposed at positions to be in contact with ink and include a material which changes to an electrically insulating film by an electrochemical reaction with the ink.

2. The substrate according to claim 1, wherein the connection sections have a smaller thickness than the individual sections and the common section.

3. The substrate according to claim 1, wherein the connection sections have a thickness of 10 to 50 nm.

4. The substrate according to claim 1, wherein the connection sections include at least one of Ta, Cr, and Ni.

5. The substrate according to claim 1, wherein the second protection layer is formed of two or more layers, and the connection sections are formed of part of the layers forming the second protection layer.

6. An inkjet print head comprising:

a substrate for the inkjet print head comprising:

a base;

a plurality of heating resistors for heating ink, the heating resistors being disposed on the base and producing heat in a case where the heating resistors are energized;

a first protection layer disposed on the heating resistors and having electrical insulation properties; and a second protection layer disposed on the first protection layer and having conductivity, wherein the second protection layer includes individual sections disposed to individually cover the plurality of heating resistors, a common section, and connection sections interposed between the individual sections and the common section and connecting the individual sections and the common section, the individual sections corresponding to adjacent heating sections are separated from each other with a gap therebetween, the connection sections respectively have a part, the cross-sectional area of which is narrower than a cross-sectional area of the corresponding individual sections, the cross-sectional areas being orthogonal to the base, and the connection sections are disposed at positions to be in contact with ink and include a material which changes to an electrically insulating film by an electrochemical reaction with the ink; and a flow path forming member adhered to an upper side of the substrate on which the second protection layer is disposed, the flow path forming member defining liquid chambers capable of storing ink at positions corresponding to the heating resistors between the flow path forming member and the substrate, and having ejection ports for ejecting ink at positions facing to the heating resistors, wherein the inkjet print head heats ink stored in the liquid chambers by energizing the heating resistors to form bubbles in the ink, thereby ejecting ink droplets from the ejection ports.

7. The inkjet print head according to claim 6, wherein a potential applied to the heating resistors is higher than a potential of the ink stored in the liquid chambers.

8. An inkjet printing apparatus for conducting printing on a print medium by using an inkjet print head, wherein the inkjet print head comprises:

a substrate for the inkjet print head comprising:

a base;

a plurality of heating resistors for heating ink, the heating resistors being disposed on the base and producing heat in a case where the heating resistors are energized;

a first protection layer disposed on the heating resistors and having electrical insulation properties; and a second protection layer disposed on the first protection layer and having conductivity, wherein the second protection layer includes individual sections disposed to individually cover the plurality of heating resistors, a common section, and connection sections interposed between the individual sections and the common section and connecting the individual sections and the common section, the individual sections corresponding to adjacent heating sections are separated from each other with a gap therebetween, the connection sections respectively have a part, the cross-sectional area of which is narrower than a cross-sectional area of the corresponding individual sections, the cross-sectional areas being orthogonal to the base, and the connection sections are disposed at positions to be in contact with ink and include a material which changes to an electrically insulating film by an electrochemical reaction with the ink; and a flow path forming member adhered to an upper side of the substrate on which the second protection layer is disposed, the flow path forming member defining liquid chambers capable of storing ink at positions corresponding to the heating resistors between the flow path forming member and the substrate, and having ejection ports for ejecting ink at positions facing to the heating resistors, wherein the inkjet print head heats ink stored in the liquid chambers by energizing the heating resistors to form bubbles in the ink, thereby ejecting ink droplets from the ejection ports, and the inkjet print head is grounded via the inkjet printing apparatus.

9. A substrate for an inkjet print head comprising:

a base;

a plurality of heating resistors for heating ink, the heating resistors being disposed on the base and producing heat in a case where the heating resistors are energized;

a first protection layer disposed on the heating resistors and having electrical insulation properties; and a second protection layer disposed on the first protection layer and having conductivity, wherein the second protection layer includes individual sections disposed to individually cover the plurality of heating resistors, a common section, and connection sections interposed between the individual sections and the common section and connecting the individual sections and the common section, the individual sections corresponding to adjacent heating sections are separated from each other with a gap therebetween, the connection sections respectively have a part, the cross-sectional area of which is narrower than a cross-sectional area of the corresponding individual sections, the cross-sectional areas being orthogonal to the base, and the connection sections are disposed at positions to be in contact with ink and include at least one of Ta, Cr, and Ni.

10. The substrate according to claim 9, wherein the connection sections have a smaller thickness than the individual sections and the common section.

11. The substrate according to claim 9, wherein the second protection layer is formed of two or more layers, and the connection sections are formed of part of the layers forming the second protection layer.

* * * * *